US010570353B2

(12) United States Patent
Wycoff

(10) Patent No.: US 10,570,353 B2
(45) **Date of Patent: *Feb. 25, 2020**

(54) CLEANING COMPOSITIONS

(71) Applicant: Ascent IP Holdings, LLC, Longmont, CO (US)

(72) Inventor: Jeffrey Wycoff, Boulder, CO (US)

(73) Assignee: Ascent IP Holdings, LLC, Longmont, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/936,204

(22) Filed: Mar. 26, 2018

(65) Prior Publication Data

US 2018/0216032 A1 Aug. 2, 2018

Related U.S. Application Data

(63) Continuation of application No. 12/655,855, filed on Jan. 9, 2010, now Pat. No. 9,926,514.

(60) Provisional application No. 61/204,704, filed on Jan. 9, 2009.

(51) Int. Cl.

| | |
|---|---|
| ***C11D 1/83*** | (2006.01) |
| ***C11D 3/04*** | (2006.01) |
| ***C11D 1/66*** | (2006.01) |
| ***C11D 1/02*** | (2006.01) |
| ***C11D 3/42*** | (2006.01) |
| ***C11D 3/00*** | (2006.01) |

(52) U.S. Cl.

CPC ..... *C11D 1/83* (2013.01); *C11D 1/02* (2013.01); *C11D 1/66* (2013.01); *C11D 3/044* (2013.01); *C11D 3/42* (2013.01); *C11D 3/0005* (2013.01)

(58) Field of Classification Search

CPC ..... C11D 1/83

See application file for complete search history.

(56) References Cited

U.S. PATENT DOCUMENTS 5,789,365 A * 8/1998 Blokzijl ..... C11D 3/3715 510/292

6,365,561 B1 * 4/2002 Vinson ..... C11D 3/0094 510/235

6,583,096 B1 * 6/2003 Kott ..... C11D 1/22 510/357

* cited by examiner

*Primary Examiner* — Ling Siu Choi
*Assistant Examiner* — Thuy-Ai N Nguyen
(74) *Attorney, Agent, or Firm* — Craig R. Miles; CR Miles P.C.

(57) ABSTRACT

Cleaning compositions which can be used to clean surfaces and treat materials.

1 Claim, 12 Drawing Sheets

TABLE 1. LIQUID CLEANER-1

| Raw Material | Trade Name % by weight | **Active Mat. % by weight | CAS# |
|---|---|---|---|
| Water | 29.35 | remainder | 7732-18-5 |
| Culinox 999 Salt | 5.65 | 2.0-8.0 | 7647-14-5 |
| Trilon M Liquid | 1.50 | 0.4-3.0 | 164462-16-2 |
| Alcosperse 747 | 2.00 | 0.4-3.0 | None Reported. |
| Ammonyx CDO Special | 7.60 | 2.0-8.0 | 68155-09-9 |
| Amphosol CG | 2.30 | 0.4-5.0 | 61789-40-0 |
| Glucopon 625 FE N | 9.20 | 2.0-10.0 | 110615-47-9 |
| Alpha-Step PC-48 | 44.00 | 12.0-25.0 | 149458-07-1 |
| Integra 44 | 0.20 | 0.05-0.5 | 70161-44-3 |
| Product Total | 100.00 | | |

Active material for all Tables set out in description below and identified ()

TABLE 1. LIQUID CLEANER-1

| Raw Material | Trade Name % by weight | **Active Mat. % by weight | CAS# |
|---|---|---|---|
| Water | 29.35 | remainder | 7732-18-5 |
| Culinox 999 Salt | 5.65 | 2.0-8.0 | 7647-14-5 |
| Trilon M Liquid | 1.50 | 0.4-3.0 | 164462-16-2 |
| Alcosperse 747 | 2.00 | 0.4-3.0 | None Reported. |
| Ammonyx CDO Special | 7.60 | 2.0-8.0 | 68155-09-9 |
| Amphosol CG | 2.30 | 0.4-5.0 | 61789-40-0 |
| Glucopon 625 FE N | 9.20 | 2.0-10.0 | 110615-47-9 |
| Alpha-Step PC-48 | 44.00 | 12.0-25.0 | 149458-07-1 |
| Integra 44 | 0.20 | 0.05-0.5 | 70161-44-3 |
| Product Total | 100.00 | | |

Active material for all Tables set out in description below and identified ()

Figure 1

TABLE 2. LIQUID CLEANER-2

| Raw Material | Trade Name % by weight | **Active Mat. % by weight | CAS# |
|---|---|---|---|
| Water | 27.35 | remainder | 7732-18-5 |
| Culinox 999 Salt | 5.65 | 2.0-8.0 | 7647-14-5 |
| Trilon M Liquid | 1.50 | 0.4-3.0 | 164462-16-2 |
| Alcosperse 747 | 2.00 | 0.4-3.0 | None Reported. |
| Ammonyx CDO Special | 7.60 | 2.0-8.0 | 68155-09-9 |
| Amphosol CG | 2.30 | 0.4-5.0 | 61789-40-0 |
| Glucopon 625 FE N | 9.20 | 2.0-10.0 | 110615-47-9 |
| Alpha-Step PC-48 | 44.00 | 12.0-25.0 | 149458-07-1 |
| Integra 44 | 0.20 | 0.05-0.5 | 70161-44-3 |
| Perfume-citrus scent | 0.20 | 0-1.0 | None Reported. |
| Product Total | 100.00 | | |

Figure 2

TABLE 3. LIQUID CLEANER-3

| Raw Material | Trade Name % by weight | Active Mat. % by weight | CAS # |
|---|---|---|---|
| Water | 29.35 | remainder | 7732-18-5 |
| Culinox 999 Salt | 5.65 | 2.0-8.0 | 7647-14-5 |
| Trilon M Liquid | 1.50 | 0.4-3.0 | 164462-16-2 |
| Alcosperse 747 | 2.00 | 0.4-3.0 | None Reported. |
| Ammonyx CDO Special | 7.60 | 2.0-8.0 | 68155-09-9 |
| Amphosol CG | 2.30 | 0.4-5.0 | 61789-40-0 |
| Glucopon 625 FE N | 9.20 | 2.0-10.0 | 110615-47-9 |
| Alpha-Step PC-48 | 44.00 | 12.0-25.0 | 149458-07-1 |
| Integra 44 | 0.20 | 0.05-0.5 | 70161-44-3 |
| Perfume-apple scent | 0.20 | 0-1.0 | None Reported. |
| Yellow Dye No. 5 | achieve color | | 1934-21-0 |
| Blue Dye No. 1 | achieve color | | 3844-45-9 |
| Product Total | 100.00 | | |

Figure 3

TABLE 4. Liquid Cleaner-4.

| Raw Material | Trade Name % by weight | CAS # |
|---|---|---|
| Water | 27.35 | 7732-18-5 |
| Culinox 999 Salt | 5.65 | 7647-14-5 |
| Trilon M Liquid | 1.50 | 164462-16-2 |
| Alcosperse 747 | 2.00 | None Reported. |
| Alpha-Step PC-48 | 44.00 | 149458-07-1 |
| Glucopon 625 FE N | 9.20 | 110615-47-9 |
| Ammonyx CDO Special | 7.60 | 68155-09-9 |
| Amphosol CG | 2.30 | 61789-40-0 |
| Integra 44 | 0.20 | 70161-44-3 |
| Perfume | 0.20 | None Reported. |
| Product Total | 100.00 | |

Figure 4

TABLE 5. Liquid Cleaner-5.

| Raw Material | Trade Name % by weight | CAS # |
|---|---|---|
| Water | 27.50 | 7732-18-5 |
| Culinox 999 Salt | 5.50 | 7647-14-5 |
| Trilon M Liquid | 1.50 | 164462-16-2 |
| Alcosperse 747 | 2.00 | None Reported. |
| Alpha-Step PC-48 | 44.00 | 149458-07-1 |
| Glucopon 625 FE N | 9.20 | 110615-47-9 |
| Ammonyx CDO Special | 7.60 | 68155-09-9 |
| Amphosol CG | 2.30 | 61789-40-0 |
| Integra 44 | 0.20 | 70161-44-3 |
| Perfume | 0.20 | None Reported. |
| Product Total | 100.00 | |

Figure 5

TABLE 6. Liquid Softener-1.

| Raw Material | Trade Name % by weight | Active Mat. % by weight | CAS # |
|---|---|---|---|
| Water | 86.9 | Remainder | 7732-18-5 |
| Stepantex VT 90 | 12.0 | 3.0 - 20.0 | None Reported |
| Dowflake XTRA 87% | 0.8 | 0-3.0 | None Reported |
| Ozone II AB 106222 | 0.2 | 0-1.0 | None Reported |
| Busan 1078, Interga 44 | 0.1 | 0.05-0.5% | 21564-17-0 |
| Product Total | 100.00 | | |

Figure 6

TABLE 7. Liquid Softener-2.

| Raw Material | Trade Name % by weight | CAS # |
|---|---|---|
| Water | 87.90 | 7732-18-5 |
| Accosoft 501 | 12.00 | 67-63-0 |
| Busan 1078 | 00.10 | 21564-17-0 |
| Product Total | 100.00 | |

Figure 7

TABLE 8. Laundry Detergent-1.

| Raw Material | Trade Name % by weight | Active Mat. % by weight | CAS # |
|---|---|---|---|
| Water | | Remainder | 7732-18-5 |
| DOW Flake Xtra | 0.025 | 0-3.0 | None Reported |
| Dequest 7000 | 0.95 | 0.4-0.6 | 37971-36-1 |
| Versene 100 | 0.5 | 0.1-0.3 | 10378-23-1 |
| Sodium citrate (trisodium citrate) | 2.5 | 0-5.0 | 68-04-2 |
| Borax 10 Mol | 1.5 | 0-3.0 | 1303-96-4 |
| Tinopal 5BM-GX | 0.1 | 0.0-0.7 | 13863-31-5 |
| Propylene glycol | 5.0 | 4.0-8.0 | 57-55-6 |
| PVP K-15 | 0.5 | 0.1-1.2 | 9003-39-8 |
| Bio-Soft N91-6 or Bio-Soft EC 690 | 15.0 | 6.0-20.0 | 9002-92-0 |
| Steol CS-460 | 15.0 | 6.0-25 | 0994-82-4 |
| Perfume - Blue Ozone AB106222 | 0.1 | 0-1.0 | NA |
| Sodium hydroxide 50% (caustic soda 50%) | 0.26 | 0.1-0.4 | 1310-73-2 |
| Busan 1078 | 0.05 | 0.05-0.5 | None Reported. |
| Purafect 4000L | 1.1 | 0.5-3.0 | 09014-01-1 |
| Purastar ST 15,000 L | 0.25 | 0.1-1.5 | None Reported. |

Figure 8

TABLE 9. Laundry Detergent-2.

| Raw Material | Tradename % by weight | CAS # |
|---|---|---|
| Water | 56.95 | 7732-18-5 |
| DOW Flake Xtra | 1.5% | None Reported |
| Sodium citrate (trisodium citrate) | 2.50 | 68-04-2 |
| Dequest 7000 | 0.95 | NA |
| Versene 100 | 0.50 | 10378-23-1 |
| Borax 10 Mol | 1.50 | 1303-96-4 |
| Tinopal 5BM-GX | 0.10 | 13863-31-5 |
| Propylene glycol | 5.00 | 57-55-6 |
| PVP K-30 | 0.50 | 9003-39-8 |
| Bio-Soft N91-6 or Bio-Soft EC 690 | 15.00 | None Reported |
| SLES 60 | 15.00 | None Reported |
| Perfume - Blue Ozone | 0.20 | None Reported |
| Sodium hydroxide 50% (caustic soda 50%) | 0.40 | 1310-73-2 |
| Busan 1078 | 0.05 | None Reported |
| Purafect 4000L | 1.10 | 09014-01-1 |
| Purastar ST 15,000 L | 0.25 | None Reported |
| Product Total | 100.00 | |

Figure 9

TABLE 10. LIQUIID DETERGENT-1

| Raw Material | Wt Percent |
|---|---|
| Tap Water, Soft | 49.87 |
| Dequest 7000 | 0.95 |
| Versene 100 XL | 0.50 |
| Sodium Citrate | 2.50 |
| Borax 10 Mol | 1.5 |
| ***Let Run Until Dissolved*** | |
| Tinopal 5BM-GX | 0.07 |
| **Let Run Until Dispersed*** | |
| ****Mix These Together***** | |
| Propylene Glycol | 5 |
| PVP K-15 (30%) | 0.9 |
| **Add this mix to the tank*** | |
| Bio-Soft N91-6 or Bio-Soft EC 690 | 15 |
| Steol CS-460 | 15 |
| Alcosperse 747 | 4 |
| Sorez 100 | 0.9 |
| AB 108539 Unscented Mask Mod 1 | 0.1 |
| Sodium Hydroxide 50 % (Caustic Soda 50%) | 0.264 |
| **Stop Mix, Check pH**** | |
| **If the pH is in check, continue*** | |
| Busan 1078 | 0.15 |
| Purafect 4000L | 0.9 |
| Purastar ST 15,000 L | 0.4 |
| **Mix these together*** | |
| Defoamer | 0.4 |
| Water | 1.6 |
| **Add this mix to the tank*** | |
| **Let run until all the Tinopal is dissolved** | |
| Total | 100.00 |

Figure 10

TABLE 11. LIQUID DETERGENT-2

| Raw Material | Wt Percent | Grams |
|---|---|---|
| Tap Water | 26.323 | 1681 |
| Dequest 7000 | 1.100 | 70 |
| Versene 100 XL | 0.500 | 32 |
| Sodium Citrate | 2.500 | 160 |
| Borax 10 Mol | 1.500 | 96 |
| ***Let Run Until Dissolved*** | | |
| Tinopal 5BM-GX | 0.070 | 4.5 |
| **Let Run Until Dispersed*** | | |
| ****Mix These Together***** | | |
| Propylene Glycol | 5.000 | 319 |
| PVP K-15 (30%) | 0.900 | 57 |
| **Add this mix to the tank*** | | |
| Tomadol 91-6 | 15.000 | 958 |
| SLES 30% | 24.000 | 1532 |
| DDBSA | 7.000 | 447 |
| Ammonyx LO | 4.000 | 255 |
| Alcosperse 747 | 5.000 | 319 |
| Sorez 100 | 1.200 | 77 |
| Ozone Blue Perfume | 0.300 | 19 |
| Sodium Hydroxide 50 % (Caustic Soda 50%) | 1.000 | 64 |
| Monoethanolamine | 0.900 | 57 |
| **Stop Mix, Check pH**** | | |
| **If the pH is in check, continue*** | | |
| Busan 1078 | 0.150 | 10 |
| Purafect 4000L | 0.900 | 57 |
| Lipolase 100L | 0.200 | 13 |
| Purastar ST 15,000 L | 0.450 | 29 |
| **Mix These together | | |
| Defoamer | 0.400 | 26 |
| Water | 1.600 | 102 |
| ***Add this Mix to the Tank** | | |
| Pylam Brilliant Blue Dye - S-566 | 0.007 | 0.4 |
| **Let run until all the Tinopal is dissolved** | | |
| Total | 100.000 | 6384 |

Figure 11

TABLE 12. LIQUID DETERGENT-3

| Raw Material | Wt Percent | |
|---|---|---|
| Water | 42.329 | 3378 |
| Dequest 7000 | 1.450 | 116 |
| Versene 100 XL | 0.500 | 40 |
| Sodium Citrate | 2.500 | 200 |
| Borax 10 Mol | 1.500 | 120 |
| ***Let Run Until Dissolved*** | | |
| Tinopal 5BM-GX | 0.100 | 8.0 |
| **Let Run Until Dispersed*** | | |
| ****Mix These Together***** | | |
| Propylene Glycol | 5.000 | 399 |
| PVP K-15 (30%) | 1.667 | 133 |
| **Add this mix to the tank*** | | |
| Tomadol 91-6 | 15.000 | 1197 |
| SLES 60% | 12.000 | 958 |
| DDBSA | 7.000 | 559 |
| Ammonyx LO | 4.000 | 319 |
| Alcosperse 747 | 2.000 | 160 |
| Sorez 100 | 0.700 | 56 |
| Ozone Blue Perfume | 0.300 | 24 |
| Sodium Hydroxide 50 % (Caustic Soda 50%) | 1.000 | 80 |
| Monoethanolamine | 0.900 | 72 |
| **Stop Mix, Check pH**** | | |
| **If the pH is in check, continue*** | | |
| Busan 1078 | 0.150 | 12 |
| Purafect 4000L | 1.400 | 112 |
| Lipolase 100L | 0.250 | 20 |
| Purastar ST 15,000 L | 0.250 | 20 |
| Pylam Brilliant Blue Dye - S-566 | 0.004 | 0.4 |
| **Let run until all the Tinopal is dissolved** | | |
| Total | 100.000 | 7980 |

Figure 12

CLEANING COMPOSITIONS

I. BACKGROUND

Generally, compositions which provide a comparatively enhanced level of non-toxicity and biodegradability which can be used to clean or condition materials.

A number of environmental labeling, purchasing, and stewardship standards exist that have established criteria for the human health and environmental performance of cleaning products. For example, In North America, these include, but are not limited to, the following:

Canadian Environmental Choice (EcoLogo Program) standards for laundry detergent/fabric softener (CCD-105) and for hard surface cleaners (CCD-146);

Green Seal standards for industrial and institutional cleaners (GS-37);

US Environmental Protection Agency (USEPA) environmentally preferable purchasing guidelines on cleaning products;

Globally Harmonized System of Classification and Labeling of Chemicals (GHS);

City of Santa Monica, Calif. purchasing criteria for industrial and institutional cleaners;

State of Minnesota environmentally preferable purchasing guidelines for cleaners; and Commonwealth of Massachusetts environmentally preferable purchasing guidelines for cleaners.

A wide variety of human health data sources allow each of the chemicals in a product to be compared with the criteria of one or more of the stewardship standards above-identified. For example with respect to Acute Oral Toxicity (LD50) data sources can be utilized, as follows:

National Library of Medicine Toxicology Network (TOXNET) Hazardous Substances Data Bank (HSDB), an on-line database;

Registry of Toxic Effects of Chemical Substances (RTECS®) database online (for ingredients without acute toxicity data on HSDB); and Sax's Dangerous Properties of Industrial Materials, 10th Ed, 2000 (lists skin and eye irritants by classification);

As to Biodegradability data sources can be utilized, as follows:

Material Safety Data Sheets (MSDS) for chemical constituents of interest Carcinogenicity.

As to Carcinogenicity data sources can be utilized, as follows:

State of California Environmental Protection Agency's "Chemicals Known to the State to Cause Cancer or Reproductive Toxicity" (issue date Nov. 14, 2003), which contains a list of carcinogens and reproductive toxins identified by the Safe Drinking Water and Toxic Enforcement Act of 1986 (Proposition 65);

USEPA Integrated Risk Information System (IRIS) database (cancer weight of evidence classifications); and The US Department of Energy's (DOE) Brookhaven National Laboratory (BNL) "BNL Laboratory Standard Carcinogen List" (issue date May 3, 2006), which contains a compilation of cancer ratings, including those from the International Agency for Research on Cancer (IARC), the American Conference of Governmental Industrial Hygienists (ACGIH), and the National Toxicology Program, Public Health Service, US Department of Health and Human Services (NTP).

As to Reproductive Toxicity data sources can be utilized, as follows:

State of California Environmental Protection Agency's "Chemicals Known to the State to Cause Cancer or Reproductive Toxicity" (issue date Nov. 14, 2003), which contains a list of carcinogens and reproductive toxins implemented by the Safe Drinking Water and Toxic Enforcement Act of 1986 (Proposition 65); and DOE BNL Reproductive Toxins (issue date Sep. 26, 2005), which contains a compilation of reproductive toxin ratings including those from the Occupational Safety and Health Administration (OSHA), ACGIH, and the NTP.

As to Mutagenicity data sources can be utilized, as follows:

TOXNET HSDB.

As to Endocrine Disruption data sources can be utilized to check for the presence of alkylphenol ethoxylate (APE) surfactants, APE derivatives such as nonylphenol, octylphenol, nonylphenol monoethoxylate, and nonylphenol diethoxylate), and phthalates, which are suspected endocrine disrupters.

As to Skin Sensitizers data sources can be utilized, as follows:

Haz-Map®, an on-line occupational health database; and

Sax's Dangerous Properties of Industrial Materials, 10th Ed, 2000 (lists skin and eye irritants by classification).

As to Hazardous Air Pollutants data sources can be utilized, as follows:

USEPA Air Toxics Web Site's list of hazardous air pollutants.

As to Volatile Organic Compounds (VOC) data sources can be utilized to check to ensure that chemicals considered to be VOCs did not make up more than 1 percent of the product, by weight.

As to Persistent Bioaccumulative Toxins (PBT) data sources can be utilized, as follows:

USEPA's 31 Priority.

A significant problem with conventional compositions for the cleaning and conditioning of materials can be that they do not meet or far exceed these relevant and applicable standards.

The inventive cleaning compositions described herein address this issue by providing a comparatively enhanced level of non-toxicity and biodegradability which can be used to clean or condition materials.

II. SUMMARY OF THE INVENTION

Accordingly, a broad object of the invention can be to provide compositions which can be applied to surfaces and materials to clean or condition the surfaces or materials.

Naturally, further objects of the invention are disclosed throughout other areas of the specification, drawings, photographs, and claims.

III. A BRIEF DESCRIPTION OF THE DRAWINGS

FIG. 1 provides a list of ingredients of a particular embodiment of a liquid cleaning composition useful for cleaning surfaces.

FIG. 2 provides a list of ingredients of a particular embodiment of a liquid cleaning composition useful for cleaning surfaces.

FIG. 3 provides a list of ingredients of a particular embodiment of a liquid cleaning composition useful for cleaning surfaces.

FIG. 4 provides a list of ingredients of a particular embodiment of a liquid cleaning composition useful for cleaning surfaces.

FIG. 5 provides a list of ingredients of a particular embodiment of a liquid cleaning composition useful for cleaning surfaces.

FIG. 6 provides a list of ingredients of a particular embodiment of a liquid softener composition useful for treatment of materials.

FIG. 7 provides a list of ingredients of a particular embodiment of a liquid softener composition useful for treatment of materials.

FIG. 8 provides a list of ingredients of a particular embodiment of a detergent composition useful for cleaning of materials.

FIG. 9 provides a list of ingredients of a particular embodiment of a detergent composition useful for cleaning of materials.

FIG. 10 provides a list of ingredients of a particular embodiment of a detergent composition useful for cleaning of materials.

FIG. 11 provides a list of ingredients of a particular embodiment of a detergent composition useful for cleaning of materials.

FIG. 12 provides a list of ingredients of a particular embodiment of a detergent composition useful for cleaning of materials.

IV. DETAILED DESCRIPTION OF THE PREFERRED EMBODIMENTS

Generally, compositions which can be applied to materials or surfaces to clean or condition materials. Specifically, compositions useful as a dish cleaner and as a cleaner or conditioner of fabrics.

Each of several particular embodiments of the inventive compositions (also referred to as "formulations") are described by the lists of raw materials set out in Tables 1 through 5 each list accompanied by a method of mixing or blending the raw materials listed and a method of use for each composition. Also, described is a comparison of each of the compositions to the criteria established for the above-described EcoLogo CCD-146 standard for hard surface cleaners, and to a lesser extent the Green Seal standard for industrial and institutional cleaners GS-37.

In regard to comparing the compositions to the EcoLogo CCD-146 standard and Green Seal standard determination of acute toxicity to humans from the use of the composition is typically accomplished through comprehensive animal testing. However, if enough information is known about the raw materials which are blended to produce the composition (also referred to as a "constituent" or "ingredient" or "chemical ingredient"), it may be acceptable to evaluate the composition without conducting laboratory studies. Using the known toxicity data for each of the chemical ingredients within the composition, an estimate of the composition's toxicity can be made using the following method:

$$TP = \left( \sum_{i=1}^{n} \frac{wt_i}{TV_i} \right)^{-1}$$

Where,
TP=toxicity of the composition, mg/kg
wti=the weight fraction of the ingredient
TV=the toxicity value for each ingredient (LD50), mg/kg
n=number of ingredients The cutoff criterion for acceptance when using this method is an oral LD50 toxicity score of greater than 5,000 mg/kg, a score that is specified in EcoLogo CCD-146 for cleaning products with low potential for environmental illness and endocrine disruption. EcoLogo CCD-146 also specifically lists criteria for dish cleaners under this standard. If toxicity data do not exist for all ingredients in the product, this method may not be conclusive (for example, unknown ingredients can significantly change the score if they turn out to be acutely toxic to humans). This method is described in greater detail in EcoLogo CCD-146 or in Appendix A of Green Seal standard GS-37.

Now referring to FIGS. 1-5 and Tables 1-5 below, each provide a formulation for a liquid cleaner useful as a dish cleaner; however, this specific example of using the liquid cleaner as a dish cleaner or to wash dishes is not intended to be limiting with respect to the numerous and wide variety of uses which can be made of the liquid cleaner to, without limitation, clean the surfaces of fixtures, tile, plastic laminates, stainless glass, pottery, glass, wood, furniture, concrete, porcelain, paint surfaces, sink basins, counter tops, floors, cabinets, or the like.

TABLE 1

LIQUID CLEANER-1

| Raw Material | Trade Name % by weight | **Active Mat. % by weight | CAS# |
|---|---|---|---|
| Water | 29.35 | remainder | 7732-18-5 |
| Culinox 999 Salt | 5.65 | 2.0-8.0 | 7647-14-5 |
| Trilon M Liquid | 1.50 | 0.4-3.0 | 164462-16-2 |
| Alcosperse 747 | 2.00 | 0.4-3.0 | None Reported. |
| Ammonyx CDO Special | 7.60 | 2.0-8.0 | 68155-09-9 |
| Amphosol CG | 2.30 | 0.4-5.0 | 61789-40-0 |
| Glucopon 625 FE N | 9.20 | 2.0-10.0 | 110615-47-9 |
| Alpha-Step PC-48 | 44.00 | 12.0-25.0 | 149458-07-1 |
| Integra 44 | 0.20 | 0.05-0.5 | 70161-44-3 |
| Product Total | 100.00 | | |

Active material for all Tables set out in description below and identified ()

TABLE 2

LIQUID CLEANER-2

| Raw Material | Trade Name % by weight | **Active Mat. % by weight | CAS# |
|---|---|---|---|
| Water | 27.35 | remainder | 7732-18-5 |
| Culinox 999 Salt | 5.65 | 2.0-8.0 | 7647-14-5 |
| Trilon M Liquid | 1.50 | 0.4-3.0 | 164462-16-2 |
| Alcosperse 747 | 2.00 | 0.4-3.0 | None Reported. |
| Ammonyx CDO Special | 7.60 | 2.0-8.0 | 68155-09-9 |
| Amphosol CG | 2.30 | 0.4-5.0 | 61789-40-0 |
| Glucopon 625 FE N | 9.20 | 2.0-10.0 | 110615-47-9 |
| Alpha-Step PC-48 | 44.00 | 12.0-25.0 | 149458-07-1 |
| Integra 44 | 0.20 | 0.05-0.5 | 70161-44-3 |
| Perfume-citrus scent | 0.20 | 0-1.0 | None Reported. |
| Product Total | 100.00 | | |

TABLE 3

LIQUID CLEANER-3

| Raw Material | Trade Name % by weight | Active Mat. % by weight | CAS # |
|---|---|---|---|
| Water | 29.35 | remainder | 7732-18-5 |
| Culinox 999 Salt | 5.65 | 2.0-8.0 | 7647-14-5 |
| Trilon M Liquid | 1.50 | 0.4-3.0 | 164462-16-2 |

TABLE 3-continued

| LIQUID CLEANER-3 | | | |
|---|---|---|---|
| Raw Material | Trade Name % by weight | Active Mat. % by weight | CAS # |
| Alcosperse 747 | 2.00 | 0.4-3.0 | None Reported. |
| Ammonyx CDO Special | 7.60 | 2.0-8.0 | 68155-09-9 |
| Amphosol CG | 2.30 | 0.4-5.0 | 61789-40-0 |
| Glucopon 625 FE N | 9.20 | 2.0-10.0 | 110615-47-9 |
| Alpha-Step PC-48 | 44.00 | 12.0-25.0 | 149458-07-1 |
| Integra 44 | 0.20 | 0.05-0.5 | 70161-44-3 |
| Perfume-apple scent | 0.20 | 0-1.0 | None Reported. |
| Yellow Dye No. 5 | achieve color | | 1934-21-0 |
| Blue Dye No. 1 | achieve color | | 3844-45-9 |
| Product Total | 100.00 | | |

TABLE 4

| Liquid Cleaner-4. | | |
|---|---|---|
| Raw Material | Trade Name % by weight | CAS # |
| Water | 27.35 | 7732-18-5 |
| Culinox 999 Salt | 5.65 | 7647-14-5 |
| Trilon M Liquid | 1.50 | 164462-16-2 |
| Alcosperse 747 | 2.00 | None Reported. |
| Alpha-Step PC-48 | 44.00 | 149458-07-1 |
| Glucopon 625 FE N | 9.20 | 110615-47-9 |
| Ammonyx CDO Special | 7.60 | 68155-09-9 |
| Amphosol CG | 2.30 | 61789-40-0 |
| Integra 44 | 0.20 | 70161-44-3 |
| Perfume | 0.20 | None Reported. |
| Product Total | 100.00 | |

TABLE 5

| Liquid Cleaner-5. | | |
|---|---|---|
| Raw Material | Trade Name % by weight | CAS # |
| Water | 27.50 | 7732-18-5 |
| Culinox 999 Salt | 5.50 | 7647-14-5 |
| Trilon M Liquid | 1.50 | 164462-16-2 |
| Alcosperse 747 | 2.00 | None Reported. |
| Alpha-Step PC-48 | 44.00 | 149458-07-1 |
| Glucopon 625 FE N | 9.20 | 110615-47-9 |
| Ammonyx CDO Special | 7.60 | 68155-09-9 |
| Amphosol CG | 2.30 | 61789-40-0 |
| Integra 44 | 0.20 | 70161-44-3 |
| Perfume | 0.20 | None Reported. |
| Product Total | 100.00 | |

Specifically with respect to the formulations provided by Tables 1-5 and in general to all the formulations provided in this description, it can be understood that different formulations can contain the same raw materials but can be distinguished by the difference in the weight percent of each of the raw materials. As a non-limiting example, the weight percent of Culinox 999 Salt admixed in the formulation of Table 4 can be 5.65 percent by weight while the weight percent of Culinox 999 Salt admixed in the formulation of Table 5 can be 5.50 percent by weight. Specific differences in weight percent of each raw material between the formulation of Table 4 and Table 5 can result in liquid cleaners having different functional characteristics or properties such as migration, wetting, capillary, retention, brightness, scent, critical micellular concentration, size of micelles, bubble volume, miscibility, color, or the like. Accordingly, it will be understood that each particular weight percent value for a raw material can form another embodiment of the inventive liquid cleaner. For example, the formulation of Table 4 is a first embodiment of the invention and the formulation of Table 5 is a second embodiment of the invention each discrete from one another. Also, it is to be understood that the ranges established by the differences of the particular weight percent values for each raw material (for example, as shown in Tables 1-3) can include the outliers in the normal variation of each particular value necessary to achieve one or more particular functional characteristics or can be the variation inherent to the manufacturing process of a particular formulation. Accordingly as to Tables 1-3, a value range can describe either a single embodiment of the inventive liquid cleaner having a formulation that can vary as to any particular raw material between the particular weight percent values, or two different liquid cleaners differentiated by the extremes of the weight percent values of each raw material each extreme having the normal degree of variation based on manufacturing practices, or a plurality of different liquid cleaners each having a discrete formulation which includes a weight percent value of each raw material which falls in the range of weight percent values established by the difference in weight percent values (with normal variation in weight percent due to the manufacturing process). Additionally, each particular value listed in Tables 1-5 is not intended to be interpreted solely as an absolute value but is also intended to include in the alternative an embodiment which includes the term "about" for the particular value (for example, 5.50 weight percent Culinox 999 shall also be interpreted as an alternative embodiment of "about 5.50 weight percent Culinox 999"). The term "about" shall be interpreted by its usual dictionary definition.

Generally, as to each of the formulations set out in Tables 1 through Table 5 (and any other tables provided herein), each particular weight percent value shall not be interpreted solely as an absolute value and each particular weight percent value as to each raw material will be interpreted as having a range between a first particular weight percent value and a second particular weight percent value based upon normal variation in the manufacturing process of the formulation, these ranges may be expressed herein as from "about" one particular value to "about" another particular value. When such a range is expressed, another embodiment includes from the one particular value to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

The term "water" in formulations described herein can be de-ionized water but could also be a filtered, distilled, or water otherwise filtered or purified to the desired purity) can be transferred to a mixing tank and the mixer started.

The trade name Culinox 999 Salt available from Morton International, Inc., Morton Salt, 123 North Wacker Drive, Chicago, Ill., USA 60606 comprises 100 percent CAS No. 7647-14-5 **Sodium Chloride.

The trade name Trilon M Liquid available from BASF, 100 Campus Drive, Florham Park, N.J. in the formulations described herein comprises the following ingredients by weight percent:

| | |
|---|---|
| CAS No. 164462-16-2 | **Alanine, N,N-bis(carboxymethyl)-, trisodium salt >=82.0-<= 84.0% |
| CAS No. 7732-18-5 | Water >=13.0-<=17.0% |
| CAS No. 1310-73-2 | Sodium Hydroxide >=0.2-<=2.0% |
| CAS No. 139-13-9 | Nitrilotriacetic acid <=1.0% |

The trade name Alcosperse 747 available from Alco Chemical, a division of National Starch & Chemical Company, 909 Mueller Drive, Chattanooga, Tenn. 37406, USA comprises about equal weight (1:1) ratios of **sodium acrylate polymer and styrene moieties, and has an average molecular weight of about 3,000.

The trade name Ammonyx CDO Special available from Stepan Company 22 West Frontage Road, Northfield, Ill. 60093 comprises the following ingredients by weight percent:

| | |
|---|---|
| CAS No. 68155-09-9 | **Cocamidopropylamine Oxide 31.8-33.7% |
| CAS No. 7732-18-5 | Water 65-68% |
| CAS No. 7722-84-1 | Hydrogen peroxide 0.25% maximum |

The trade name Amphosol CG available from Stepan Company 22 West Frontage Road, Northfield, Ill. 60093 comprises the following ingredients by weight percent:

| | |
|---|---|
| CAS No. 7732-18-5 63 | Water 67% |
| CAS No. 61789-40-0 | **Cocamidopropyl betaine 29-31% |
| CAS No. 7647-14-5 4 | Sodium chloride 6% |
| CAS No. 56-81-5 0 | Glycerin 3% |

The trade name Glucopon 625 FE available from Cognis Corporation, 4900 Este Avenue, Cincinnati, Ohio 45232 comprises the following ingredients by weight percent:

| | |
|---|---|
| CAS No. 110615-47-9 | **D-Glucopyranoside, C10-16, oligomeric 50% |
| CAS No. 7732-18-5 | Water 50% |

The trade name Alpha-Step PC-48 available from Stepan Company 22 West Frontage Road, Northfield, Ill. 60093 comprises the following ingredients by weight percent:

| | |
|---|---|
| CAS No. 7732-18-5 63 | Water 56-59% |
| CAS No. 149458-07-1 | **Fatty acids, C12-18, Me esters, sulfonated, sodium salts 37-40% |
| CAS No. 7757-82-6 | Sodium sulfate <3% |

The trade name Interga 44 available from ISP (Canada) Inc., 44055 Sladeview Circle, No. 7, Mississauga, Ontario, Canada L5L 5Y1 comprises the following ingredients by weight percent:

| | |
|---|---|
| CAS 70161-44-3 | **Glycine, N-(hydroxymethyl)-, monosodium salt 50% |
| CAS No. 7732-18-5 63 | Water 50% |

Specifically, with respect to the raw material identified as "perfume" or "fragrance", it is intended that as to each formulation in Tables 1-5 can include between none and about 1.0 weight percent perfume. Certain embodiments above omit the perfume while other embodiments can have a greater or lesser weight percent of between zero weight percent and about 1.0 weight percent perfume adjusted to achieve the desired fragrance or scent with the weight percent of all other raw materials adjusted accordingly. The term "perfume" includes a wide and numerous variety of chemicals which can be added to the admixture of raw materials to provide a desired scent such as citrus scent or green apple scent, lemon scent, or the like. Specifically, as to the compositions of Table 1-5 "Citrus Fragrance" or "Green Apple Fragrance" can be utilized respectively as the perfume ingredient which can be obtained from Arylessence, Inc., 1091 Lake Drive, Marietta, Ga.

Where trade names or trademarks are utilized in Tables 1-5 or any table herein the trade name material or the trademark material can be utilized or its equivalent product and are understood to have the chemicals or ingredients in the amounts or combinations as indicated below. It is further understood that where a trade name or trademark material is utilized in a Table that the chemicals or ingredients in the amounts and combinations as indicated below can be prepared and utilized to avoid use of the trade mark or trade name material. A person of ordinary skill in the art can convert the weight percentages shown in the Tables to prepare determine the amount of each ingredient or component to mix when the equivalent of the trademark or trade name material is prepared.

The raw materials listed in Tables 1-5 can be admixed to produce the composition by the following general procedure. The batch maker being sure that the mixing tanks are cleaned of any contamination. The water (which will typically be de-ionized water but could also be a filtered, distilled, or water otherwise filtered or purified to the desired purity) and the Culinox 999 Salt can be transferred to a mixing tank and mixed until dissolved. Each of the Culinox 999 Salt. Trilon M Liquid, Alcosperse 747, Ammonyx CDO Special and Amphosol CG can be added serially and mixed for about 15 minutes or until fully dissolved and uniform. To the resulting mixture add Alpha-Step PC-48 and mix for about 15 minutes or until fully uniform. To the resulting mixture add Integra 44 along with any fragrance or dye and mix for about 15 minutes or until uniform.

As to the formulations of Tables 1-5, an acute oral toxicity score of 5,706 mg/kg was calculated from the acute oral toxicity data for the individual listed raw materials. This exceeds the threshold value of 5,000 mg/kg, a score that is cited in EcoLogo CCD-146 as appropriate for cleaning products with low potential for environmental illness and endocrine disruption. It should be noted that water and the perfume were not included in this analysis, and an LD50 of 1,000 mg/kg was conservatively estimated for the acrylic copolymer Alcosperse 747 in the absence of published data. Acute oral toxicity was considered negligible for water. Finally, the formulations of Table 1 and Table 2 was not evaluated for acute inhalation toxicity (LC50) because of the non-volatile nature of the formulations, which limit the potential for acute exposure at room temperature.

Again referring to the formulations of Tables 1-5, biodegradability was evaluated for each listed raw material by referring to the associated MSDS. If the raw material was reported as readily biodegradable as determined by OECD (Organization for Economic Cooperation and Development, based in Paris, France) criteria or inorganic, the weight fraction was included in the total biodegradable weight fraction. Information about the biodegradability of Alcosperse 747 and Blue Ozone was not available, so these ingredients were conservatively considered non-biodegradable for the purposes of this calculation. Using these assumptions and published data the compositions of Table 1 and Table 2 are considered to be 97.8% biodegradable.

Again referring to the formulations of Table 1-5, the weight percentage of these formulations that can be considered "natural" was calculated by adding the weight fraction of all the natural ingredients. Using this method, this product is considered to be 97.8% natural.

Again referring to Tables 1-5, Trilon M Liquid contains trace amounts of two suspected carcinogens. The first, formaldehyde (0.05% of Trilon M Liquid) comprises only 0.0008 weight percent of the formulations of Table 1 and Table 2, accordingly, the hazard for carcinogenicity, mutagenicity, skin sensitization, and air pollution is considered to be negligible. The second, trisodium nitrilotriacetate (0.5% of Trilon M Liquid) comprises only 0.0075 weight percent of the formulations of Table 1 and Table 2, accordingly, the toxicity risk is also considered to be negligible.

Three chemicals were identified as skin sensitizers in addition to the Trilon M Liquid constituents: sodium hydroxide, hydrogen peroxide, and cocamidopropyl betaine. These were present in concentrations of 0.015%, 0.019%, and 0.68%, respectively, in the formulations of Table 1 and Table 2. According to the United Nations GHS criteria, skin sensitizers present at a concentration of 0.1% or greater by weight meet the definition of a skin sensitizer classification of the entire mixture as a skin sensitizer. Since cocamidopropyl betaine exceeds this threshold, it may be considered a skin sensitization.

A potential risk for mutagenicity is shown by published toxicity data to be posed by hydrogen peroxide, which is contained in Ammonyx CDO Special (Tables 1-5). Hydrogen peroxide is used in a variety of consumer products at much higher concentrations than 0.019% (e.g., toothpaste). Although an underlying genotoxic mechanism cannot be excluded, the weight of evidence at this time does not suggest that exposure to hydrogen peroxide during the routine use of this consumer product would create a significant risk to human health.

Overall, the formulations of Tables 1-5 when assessed by the above identified criteria no significant human health or environmental effects were identified.

Now referring to FIG. 3 and Table 3, provide a formulation for a liquid softener useful for conditioning fabrics; however, this specific example of using the liquid softener to condition fabrics is not intended to be limiting with respect to the numerous and wide variety of uses which can be made of the liquid softener to without limitation generally condition material such as textiles, paper, leather, or the fibers thereof, remove static electricity from materials, or coat surfaces to provide lubricant properties. Additionally, although the formulation provides a liquid which can be dispensed directly, or indirectly by mixing with water, to the surface of fibers or materials made of fibers such as cotton fibers, the invention is not so limited and the formulation can be applied to a substrate material and the substrate material engaged with the surface of fibers or materials made of fibers to deliver the formulation.

Now referring to FIGS. 6-7 and Tables 6-7 below, each provide a formulation for a liquid softener useful in treating fabrics or fibers.

TABLE 6

Liquid Softener-1.

| Raw Material | Trade Name % by weight | Active Mat. % by weight | CAS # |
|---|---|---|---|
| Water | 86.9 | Remainder | 7732-18-5 |
| Stepantex VT 90 | 12.0 | 3.0-20.0 | None Reported |
| Dowflake XTRA 87% | 0.8 | 0-3.0 | None Reported |
| Ozone II AB 106222 | 0.2 | 0-1.0 | None Reported |
| Busan 1078, Interga 44 | 0.1 | 0.05-0.5% | 21564-17-0 |
| Product Total | 100.00 | | |

TABLE 7

Liquid Softener-2.

| Raw Material | Trade Name % by weight | CAS # |
|---|---|---|
| Water | 87.90 | 7732-18-5 |
| Accosoft 501 | 12.00 | 67-63-0 |
| Busan 1078 | 00.10 | 21564-17-0 |
| Product Total | 100.00 | |

With regard to the trade names or trademarks used in Tables 6 and 7, the following definitions apply.

The term "water" in formulations described herein can be de-ionized water but could also be a filtered, distilled, or water otherwise filtered or purified to the desired purity).

The trade name Stepantex VT 90 available from Stepan Company 22 West Frontage Road, Northfield, Ill. 60093 comprises the following ingredients by weight percent: CAS No. None Reported. **Methyl Bis[ethyl(tallowate)]-2-Hydroxethyl ammonium methyl sulfate 85-90%; and CAS No. 67-63-0 9_Isopropanol 11%

The trade name Dowflake XTRA 87% available from The Dow Chemical Company, 2030 Willard H. Dow Center, Midland, Mich. 48674 comprises the following ingredients by weight percent:

| | |
|---|---|
| CAS No. 10043-52-4 | **Calcium chloride >83.0-<87.0% |
| CAS No. 7732-18-5 | Water >8.0-<14.0% |
| CAS No. 7447-40 | Potassium chloride 7 >2.0-<3.0% |
| CAS No. 7647-14-5 | Sodium chloride >1.0-<2.0% |

The trade name Busan 1078 available from Buckman Laboratories, 1256 North McLean Blvd., Memphis, Tenn. 38108 comprises the following ingredients by weight percent:

| | |
|---|---|
| CAS No. None reported. | **5-Chloro-2-Methyl-4-isothiazolin-3-one 1.15% |
| CAS No. None reported. | 2-Methyl-4-isothiazolin-3-one. 0.35% |
| CAS No. 7732-18-5 | Water 98.5% |

The trade name Interga 44 available from ISP (Canada) Inc., 44055 Sladeview Circle, No. 7, Mississauga, Ontario, Canada L5L 5Y1 comprises the following ingredients by weight percent:

| | |
|---|---|
| CAS No. 70161-44-3 | **Glycine, N-(hydroxymethyl)-, monosodium salt 50% |
| CAS No. 7732-18-5 63 | Water 50% |

The trade name Accosoft 501 available from Stepan Company 22 West Frontage Road, Northfield, Ill. 60093 comprises the following ingredients by weight percent: CAS No. None Reported. **methyl bis(tallow alkyl amidoethyl) 2-hydroxyethyl quaternary ammonium methyl sulfate 90%; and CAS No. CAS No. 7732-18-5 63 Water 10%

The fragrance Ozone IIAB 106222 available from Arylessence, Inc. in Marietta, Ga. Optionally other fragrances may be used and are also available from Arylessence, Inc. or other fragrance suppliers.

The raw materials listed in Table 6 can be admixed to produce the composition by the following general procedure. The batch maker being sure that the mixing tanks are cleaned of any contamination. The water (which will typically be de-ionized water but could also be a filtered, distilled, or water otherwise filtered or purified to the desired purity) can be transferred to a mixing tank and heated to about 130° F. and the mixer started. Each of the Stephantex VT 90 and Dowflake XTRA 87% can be added to the water serially and each mixed until fully dissolved. The mixture is then cooled to about 90° F. and the Busan 1078 or Interga 44 (or a combination of the two) can then be added mixed for period of about 15 minutes. Blue Ozone can then be added and mixed for 30 minutes or until completely uniformily dispersed throughout the resulting composition. Samples are taken from the top of the batch and the bottom of the batch for quality control analysis.

The raw materials listed in Table 7 can be admixed to produce the composition by the following general procedure. The batch maker being sure that the mixing tanks are cleaned of any contamination. The water (which will typically be de-ionized water but could also be a filtered, distilled, or water otherwise filtered or purified to the desired purity) can be transferred to a mixing tank and heated to about 130° F. and the mixer started. Each of the DOW Flake XTRE and Accosoft 501 can be added to the water serially and each mixed until fully dissolved. The mixture is then cooled to about 90° F. and the Busan 1078 can then be added mixed for period of about 15 minutes. Blue Ozone can then be added and mixed for 30 minutes or until completely uniformily dispersed throughout the resulting composition. Samples are taken from the top of the batch and the bottom of the batch for quality control analysis.

The resulting composition of Tables 6 and 7 can be used by contacting fabrics or fibers with an effective amount, generally from about 10 ml to about 150 ml (per 3.5 kg of fiber or fabric being treated) in an aqueous bath. Of course, the amount used is based upon the judgment of the user, depending on concentration of the composition, fiber or fabric type, degree of softness desired, and the like.

The raw materials of the formulation of Table 6 and 7 were compared to the criteria established for the above-described EcoLogo CCD-146 standard for hard surface cleaners, and to a lesser extent the Green Seal standard for industrial and institutional cleaners GS-37.

Acute human oral toxicity for the formulation of Table 6 and 7 was calculated as 40,959 mg/kg. This value exceeds the threshold value of 5,000 mg/kg, a score that is cited in EcoLogo CCD-146 as appropriate for cleaning products with low potential for environmental illness and endocrine disruption. The formula of Table 3 was not evaluated for acute inhalation toxicity (LC50) because of its non-volatile nature, which limits the potential for acute exposure at room temperature.

Again referring to Tables 6 and 7, biodegradability was evaluated for each listed raw material by referring to the associated MSDS. If the raw material was reported as readily biodegradable as determined by OECD (Organization for Economic Cooperation and Development, based in Paris, France) criteria or inorganic, the weight fraction was included in the total biodegradable weight fraction. The formulation of Table 3 is 100% biodegradable.

The formula of Table 6 and 7, does not contain any carcinogenic, mutagenic, or reproductive toxins, suspected endocrine disrupters, persistent bioaccumulative toxins, or USEPA recognized hazardous air pollutants.

The microbiocide Busan 1078 contains 1.15% 5-Chloro-2-Methyl-4-isothiazolin-3-one and 0.35% 2-Methyl-4-isothiazolin-3-one, which are both listed as skin sensitizers. However, since Busan 1978 only makes up 0.1% of Ecoform Fabric Softener, these two ingredients drop to 0.0012% and 0.0004% of the total formulation of Table 3, respectively. According to the United Nations GHS criteria, skin sensitizers present at a concentration of 0.1% or greater by weight trigger classification of the entire mixture as a skin sensitizer.$_2$ Since the concentrations of the skin sensitizers in Busan 1078 are considerably lower than 0.1%, they are not considered to have a measurable effect on skin sensitization for the overall formulation.

Overall, the formulation of Tables 6 and 7 when assessed by the above identified criteria affords no significant human health or environmental effects.

Now referring to FIGS. 6-7 and Tables 6-7 below, each provide a formulation for a liquid softener useful in treating fabrics or fibers.

TABLE 8

Laundry Detergent-1.

| Raw Material | Trade Name % by weight | Active Mat. % by weight | CAS # |
|---|---|---|---|
| Water | | Remainder | 7732-18-5 |
| DOW Flake Xtra | 0.025 | 0-3.0 | None Reported |
| Dequest 7000 | 0.95 | 0.4-0.6 | 37971-36-1 |
| Versene 100 | 0.5 | 0.1-0.3 | 10378-23-1 |
| Sodium citrate (trisodium citrate) | 2.5 | 0-5.0 | 68-04-2 |
| Borax 10 Mol | 1.5 | 0-3.0 | 1303-96-4 |
| Tinopal 5BM-GX | 0.1 | 0.0-0.7 | 13863-31-5 |
| Propylene glycol | 5.0 | 4.0-8.0 | 57-55-6 |
| PVP K-15 | 0.5 | 0.1-1.2 | 9003-39-8 |
| Bio-Soft N91-6 or Bio-Soft EC 690 | 15.0 | 6.0-20.0 | 9002-92-0 |
| Steol CS-460 | 15.0 | 6.0-25 | 0994-82-4 |
| Perfume - Blue Ozone AB106222 | 0.1 | 0-1.0 | NA |
| Sodium hydroxide 50% (caustic soda 50%) | 0.26 | 0.1-0.4 | 1310-73-2 |
| Busan 1078 | 0.05 | 0.05-0.5 | None Reported. |
| Purafect 4000L | 1.1 | 0.5-3.0 | 09014-01-1 |
| Purastar ST 15,000 L | 0.25 | 0.1-1.5 | None Reported. |
| Product Total | 100.00 | | |

With regard to the trade names or trademarks used in Tables 6 and 7, the following definitions apply.

The trade name Dequest 7000 available from Thermophos Trading GmbH, Bundesplastz 1, CH-6300 Zug, Switzerland comprises the following ingredients by weight percent:

| | |
|---|---|
| CAS No. 37971-36-1 | **2-phophonobutane-1,2,4-tricarboxylic acid >=49.0-<=51.0% |
| CAS No. 17732-1 8-5 | Water >=49.0-<=51.0% |

The trade name Versene 100 available from Dow Chemical Company, 2030 Willard H. Dow Center, Midland, Mich. 48674 comprises the following ingredients by weight percent:

| | |
|---|---|
| CAS No. 7732-18-5 | Water 61.0% |
| CAS No. 64-02-8 | **Tetrasodium ethylendiamine tetraacetate 38.0% |
| CAS No. 1310-73-2 | Sodium hydroxide 1.0% |

The trade name Tinopal 5BM-GX available from Ciba Corporation, 4090 Premier Drive, High Point, 27265, N.C., USA comprises **4, 4'-Bis anilino-6 [bis (hydroxyethylmethyl) amino]-s-triazin-2-yl amino 2, 2' stilbenedisulfonic acid.

The term PVP K-15 refers to **Poly(1-vinyl-2-pyrrolidinone) CAS No. 9003-39-8.

The trade name Bio-Soft N91-6 available from Stepan Company 22 West Frontage Road, Northfield, Ill. 60093 comprises Alchols, C9-11, ethoxylated CAS No. 68439-4603 95-100%.

The trade name Bio-soft EC 690 available from Stepan Company 22 West Frontage Road, Northfield, Ill. 60093 comprises Polyethylene glycol monododecyl ether >60% CAS No. 9002-92-0.

The trade name Steol-460 available from Stepan Company 22 West Frontage Road, Northfield, Ill. 60093 comprises the following ingredients by weight percent:
CAS No. 9004-82-4 **Sodium Lareth Sulfate The trade name Busan 1078 available from Buckman Laboratories, 1256 North McLean Blvd., Memphis, Tenn. 38108 comprises the following ingredients by weight percent:

| | |
|---|---|
| CAS No. None reported. | **5-Chloro-2-Methyl-4-isothiazolin-3-one 1.15% |
| CAS No. None reported. | 2-Methyl-4-isothiazolin-3-one. 0.35% |
| CAS No. 7732-18-5 | Water 98.5% |

The trade name Purafect 4000L a liquid enzyme preparation available from Genencor, Archimedesweg 30, 2333 CN Leiden, The Netherlands comprises the following ingredients by weight percent:

| | |
|---|---|
| CAS No. 9014-01-1 | **Subtilisins (proteolytic enzymes) 4-7% |
| CAS No. 57-55-6 | Propylene glycol proprietary. |

The trade name Purastar ST 15,000L a liquid enzyme preparation available from Genencor, Archimedesweg 30, 2333 CN Leiden, The Netherlands comprises the following ingredients by weight percent:

| | |
|---|---|
| CAS No. 9014-71-5 | **Alpha-amylase 4-7% |
| CAS No. 57-55-6 | Propylene glycol proprietary. |

The raw materials listed in Table 8 can be admixed to produce the composition by the following general procedure. The batch maker being sure that the mixing tanks are cleaned of any contamination. Add the water into the mixer. Combine the DOW Flake Xtra 87%, Dequest 7000, Versene 100, Sodium citrate (trisodium citrate), and Borax 10 Mol with the amount of water. Mix until fully dissolved. Add Tinopal 5BM-GX. Mix until fully dissolved. To the resulting mixture combine and add Propylene glycol, PVP K-15, Bio-Soft N91-6 or Bio-Soft EC 690, Steol CS-460, Perfume—Blue Ozone AB106222, and Sodium hydroxide 50% (caustic soda 50%). Mix until fully dispersed and check pH. Adjust pH to between 8.25 pH and 8.5 pH. After pH has been adjusted to this range add Busan 1078, Purafect 4000L, and Purastar ST 15,000 L. Mix until all the Tinopal has dissolved to produce a composition clear and free of solids.

TABLE 9

Laundry Detergent-2.

| Raw Material | Tradename % by weight | CAS # |
|---|---|---|
| Water | 56.95 | 7732-18-5 |
| DOW Flake Xtra | 1.5% | None Reported |
| Sodium citrate (trisodium citrate) | 2.50 | 68-04-2 |
| Dequest 7000 | 0.95 | NA |
| Versene 100 | 0.50 | 10378-23-1 |
| Borax 10 Mol | 1.50 | 1303-96-4 |
| Tinopal 5BM-GX | 0.10 | 13863-31-5 |
| Propylene glycol | 5.00 | 57-55-6 |
| PVP K-30 | 0.50 | 9003-39-8 |
| Bio-Soft N91-6 or Bio-Soft EC 690 | 15.00 | None Reported |
| SLES 60 | 15.00 | None Reported |
| Perfume - Blue Ozone | 0.20 | None Reported |
| Sodium hydroxide 50% (caustic soda 50%) | 0.40 | 1310-73-2 |
| Busan 1078 | 0.05 | None Reported |
| Purafect 4000L | 1.10 | 09014-01-1 |
| Purastar ST 15,000 L | 0.25 | None Reported |
| Product Total | 100.00 | |

The trade name SLES 60 available from Stepan Company 22 West Frontage Road, Northfield, Ill. 60093 comprises CAS No. 9004-82-4 Sodium lauryl ether sulfate 60% active.

Where the constituents of a particular trade name or trademark product have been set out a first time in the description above each applies to the subsequent uses of the trade name or trademark product the Tables 1-9.

The raw materials listed in Table 9 can be admixed to produce the composition by the following general procedure. The batch maker being sure that the mixing tanks are cleaned of any contamination. Add the water into the mixer. Add PVP K-30 and mix until fully dissolved. Add Tinopal 5BM-GX. Mix until fully dissolved. Add Dequest 7000. Continue mixing and add Versene 100 and mix until fully dissolved. Add the DOW Flake Xtra. Continue mixing and add Sodium Citrate. Continue mixing until fully dissolved. Add the Borax 10 mole and mix until fully dissolved. Add the Propylene Glycol. Mix 15 minutes. Add Biosoft EC 690. Mix until fully dissolved. Add SLES 60. Mix until fully dissolved. Add Blue Ozone AB. Mix 15 minutes. Add Sodium hydroxide 50%. Mix 30 minutes. Check pH and adjust with Citric Acid or Sodium hydroxide 50% to obtain pH of the mixture in the range of about pH 8.2 to about pH 8.5. Continue to add Busan 1079. Mix 15 minutes. Add Purafect 4000L and Purastar ST 15,000 L. Mix for 60 minutes. The resulting composition should be clear and free of solids.

TABLE 10

LIQUID DETERGENT-1

| Raw Material | Wt Percent |
|---|---|
| Tap Water, Soft | 49.87 |
| Dequest 7000 | 0.95 |
| Versene 100 XL | 0.50 |
| Sodium Citrate | 2.50 |
| Borax 10 Mol | 1.5 |
| ***Let Run Until Dissolved*** | |
| Tinopal 5BM-GX | 0.07 |
| **Let Run Until Dispersed*** | |
| ****Mix These Together***** | |

TABLE 10-continued

| LIQUID DETERGENT-1 | |
|---|---|
| Raw Material | Wt Percent |
| Propylene Glycol | 5 |
| PVP K-15 (30%) | 0.9 |
| **Add this mix to the tank*** | |
| Bio-Soft N91-6 or Bio-Soft EC 690 | 15 |
| Steol CS-460 | 15 |
| Alcosperse 747 | 4 |
| Sorez 100 | 0.9 |
| AB 108539 Unscented Mask Mod 1 | 0.1 |
| Sodium Hydroxide 50% (Caustic Soda 50%) | 0.264 |
| **Stop Mix, Check pH**** | |
| **If the pH is in check, continue*** | |
| Busan 1078 | 0.15 |
| Purafect 4000L | 0.9 |
| Purastar ST 15,000 L | 0.4 |
| **Mix these together*** | |
| Defoamer | 0.4 |
| Water | 1.6 |
| **Add this mix to the tank*** | |
| **Let run until all the Tinopal is dissolved** | |
| Total | 100.00 |

Where the constituents of a particular trade name or trademark product have been set out a first time in the description above each applies to the subsequent uses of the trade name or trademark product the Tables 10-12.

The raw materials listed in Table 10 can be admixed to produce the composition by the following general procedure. The batch maker being sure that the mixing tanks are cleaned of any contamination. Add the water into the mixer. Add Dequest 7000, Versene 100 XL, Sodium Citrate, and Borax 10 Mol, and mix until fully dissolved. Add Tinopal 5BM-GX. Mix until dispersed. Mix together Propylene Glycol and PVP K-15 (30%). Add this mix to the tank. Add to the tank Bio-Soft N91-6 or Bio-Soft EC 690, Steol CS-460, Alcosperse 747, Sorez 100, AB 108539 Unscented Mask Mod 1, and Sodium Hydroxide 50% (Caustic Soda 50%). Stop mixing and check the pH. Stop Mixing. Check pH. Adjust pH with Citric Acid or Sodium Hydroxide 50% to between pH 8.25 and 8.5 with a target of 8.4. Do not add enzymes unless pH is within this range. If pH is correct then add, Busan 1078, Purafect 4000L, Purastar ST 15,000 L. Mix together Defoamer and Water and add to mix tank. Continue mixing until the Tinopal 5BM-GX is dissolved. The pH should be 8.5 with a range of between 8.25 and 8.50. The density should be about 8.75 with a viscosity (70° F.) sp3 at 30:100 with a range of 80-150. Typically about 110.

The trade name Sorez 100 is available from International Specialty Products, 1361 Alps Road, Wayne, N.J. 07470 and comprises 1,4-Benzenedicarboxylic acid, polymer with 1,2-ethanediol and alpha-hydro-omega-hydroxypoly(oxy-1,2-ethandiyl).

TABLE 11

| LIQUID DETERGENT-2 | | |
|---|---|---|
| Raw Material | Wt Percent | Grams |
| Tap Water | 26.323 | 1681 |
| Dequest 7000 | 1.100 | 70 |
| Versene 100 XL | 0.500 | 32 |
| Sodium Citrate | 2.500 | 160 |
| Borax 10 Mol | 1.500 | 96 |
| ***Let Run Until Dissolved*** | | |

TABLE 11-continued

| LIQUID DETERGENT-2 | | |
|---|---|---|
| Raw Material | Wt Percent | Grams |
| Tinopal 5BM-GX | 0.070 | 4.5 |
| **Let Run Until Dispersed*** | | |
| *****Mix These Together***** | | |
| Propylene Glycol | 5.000 | 319 |
| PVP K-15 (30%) | 0.900 | 57 |
| **Add this mix to the tank*** | | |
| Tomadol 91-6 | 15.000 | 958 |
| SLES 30% | 24.000 | 1532 |
| DDBSA | 7.000 | 447 |
| Ammonyx LO | 4.000 | 255 |
| Alcosperse 747 | 5.000 | 319 |
| Sorez 100 | 1.200 | 77 |
| Ozone Blue Perfume | 0.300 | 19 |
| Sodium Hydroxide 50% (Caustic Soda 50%) | 1.000 | 64 |
| Monoethanolamine | 0.900 | 57 |
| **Stop Mix, Check pH**** | | |
| **If the pH is in check, continue*** | | |
| Busan 1078 | 0.150 | 10 |
| Purafect 4000L | 0.900 | 57 |
| Lipolase 100L | 0.200 | 13 |
| Purastar ST 15,000 L | 0.450 | 29 |
| **Mix These together | | |
| Defoamer | 0.400 | 26 |
| Water | 1.600 | 102 |
| ***Add this Mix to the Tank** | | |
| Pylam Brilliant Blue Dye - S-566 | 0.007 | 0.4 |
| **Let run until all the Tinopal is dissolved** | | |
| Total | 100.000 | 6384 |

The raw materials listed in Table 11 can be admixed to produce the composition by the following general procedure. The batch maker being sure that the mixing tanks are cleaned of any contamination. Add the water into the mixer. Add Dequest 7000, Versene 100 XL, Sodium Citrate, and Borax 10 Mol, and mix until fully dissolved. Add Tinopal 5BM-GX. Mix until dispersed. Mix together Propylene Glycol and PVP K-15 (30%). Add to the mix tank. Then add to mix tank Tomadol 91-6, SLES 60%, DDBSA, Ammonyx LO, Alcosperse 747, Sorez 100, Ozone Blue Perfume, Sodium Hydroxide 50% (Caustic Soda 50%), and Monoethanolamine. Stop Mixing. Check pH. Adjust pH with Citric Acid or Sodium Hydroxide 50% to between pH 8.25 and 8.5 with a target of 8.4. Do not add enzymes unless pH is within this range. If pH is correct then add, Busan 1078, Purafect 4000L, Lipolase 100L, and Purastar ST 15,000. Mix together Defoamer and Water and add to mix tank. Add to the mix tank Pylam Brilliant Blue Dye—S-566. Continue mixing until the Tinopal 5BM-GX is dissolved. The product should be clear without solids. The pH should be 8.4 with a range of between 8.25 and 8.50. The density should be about 8.810 with a viscosity (70° F.) sp3 at 30:135 with a range of 80-150.

The trade name Tomadol 91-6 is available from Tomah Reserve, Inc. 474 West 19$^{th}$ Street, Reserve, La. 70084 and comprises Ethoxylated Alcohols ($C_{9-11}$) 100%.

The trade name SLES 30 available from Stepan Company 22 West Frontage Road, Northfield, Ill. 60093 comprises CAS No. 68585-34-2 Sodium lauryl ether sulfate 30% active.

The term DDBSA refers to Dodecyl Benzene Sulphonic Acid available from BHS Marketing, P.O. Box 27955, Salt Lake City, Utah 84127 CAS No. 27176-87-0.

The trade name Ammonyx LO available from Stepan Company 22 West Frontage Road, Northfield, Ill. 60093 comprises Water 68-71% CAS No. 7732-18-5 and Lauramine Oxide 29-31% CAS No. 1643-20-5.

Particularly useful lipases include enzymes derived from the microorganism Thermomyces lanuginosus, such as those available from Novo-Nordisk A/S under the trade name LIPOLASE® (CAS no. 9001-62-1). LIPOLASE® enzymes are obtained by submerged fermentation of an Aspergillus oryzae microorganism genetically modified with DNA from Thermomyces lanuginosus DSM 4109 that encodes the amino acid sequence of the lipase. LIPOLASE® 100L and LIPOLASE® 100T are available as a liquid solution and a granular solid, respectively, each having a nominal activity of 100 kLU/g. Other forms of LIPOLASE® include LIPOLASE® 50L, which has half the activity of LIPOLASE® 100L, and LIPOZYME® 100L, which has the same activity of LIPOLASE® 100L, but is food grade.

The term Brilliant Blue Dye S-566 is available from Pylam Products Company, Inc., 2175 East Cedar Street, Tempe, Ariz. 85281-7431.

The trade name Blue Ozone Fragrance AB103831 available from Arylessence, Inc., 1091 Lake Drive, Marietta, Ga. 30066. Trade secret (includes in part phenyl ethyl alcohol).

The Unscented Mask Mod 1 AB103831 available from Arylessence, Inc., 1091 Lake Drive, Marietta, Ga. 30066. Trade secret.

TABLE 12

LIQUID DETERGENT-3

| Raw Material | Wt Percent | |
|---|---|---|
| Water | 42.329 | 3378 |
| Dequest 7000 | 1.450 | 116 |
| Versene 100 XL | 0.500 | 40 |
| Sodium Citrate | 2.500 | 200 |
| Borax 10 Mol | 1.500 | 120 |
| ***Let Run Until Dissolved*** | | |
| Tinopal 5BM-GX | 0.100 | 8.0 |
| **Let Run Until Dispersed*** | | |
| ****Mix These Together***** | | |
| Propylene Glycol | 5.000 | 399 |
| PVP K-15 (30%) | 1.667 | 133 |
| **Add this mix to the tank*** | | |
| Tomadol 91-6 | 15.000 | 1197 |
| SLES 60% | 12.000 | 958 |
| DDBSA | 7.000 | 559 |
| Ammonyx LO | 4.000 | 319 |
| Alcosperse 747 | 2.000 | 160 |
| Sorez 100 | 0.700 | 56 |
| Ozone Blue Perfume | 0.300 | 24 |
| Sodium Hydroxide 50% (Caustic Soda 50%) | 1.000 | 80 |
| Monoethanolamine | 0.900 | 72 |
| **Stop Mix, Check pH**** | | |
| **If the pH is in check, continue*** | | |
| Busan 1078 | 0.150 | 12 |
| Purafect 4000L | 1.400 | 112 |
| Lipolase 100L | 0.250 | 20 |
| Purastar ST 15,000 L | 0.250 | 20 |
| Pylam Brilliant Blue Dye - S-566 | 0.004 | 0.4 |
| **Let run until all the Tinopal is dissolved** | | |
| Total | 100.000 | 7980 |

The raw materials listed in Table 11 can be admixed to produce the composition by the following general procedure. The batch maker being sure that the mixing tanks are cleaned of any contamination. Add the water into the mixer. Add Dequest 7000, Versene 100 XL, Sodium Citrate, and Borax 10 Mol, and mix until fully dissolved. Add Tinopal 5BM-GX. Mix until dispersed. Mix together Propylene Glycol and PVP K-15 (30%). Add to the mix tank. Then add to mix tank Tomadol 91-6, SLES 60%, DDBSA, Ammonyx LO, Alcosperse 747, Sorez 100, Ozone Blue Perfume, Sodium Hydroxide 50% (Caustic Soda 50%), and Monoethanolamine. Stop Mixing. Check pH. Adjust pH with Citric Acid or Sodium Hydroxide 50% to between pH 8.3 and 8.6 with a target of 8.5. Do not add enzymes unless pH is within this range. If pH is correct then add, Busan 1078, Purafect 4000L, Lipolase 100L, and Purastar ST 15,000, and Pylam Brilliant Blue Dye—S-566. Continue mixing until the Tinopal 5BM-GX is dissolved. The product should be clear without solids. The pH should be 8.5 with a range of between 8.25 and 8.50. The density should be about 8.85.

As can be easily understood from the foregoing, the basic concepts of the present invention may be embodied in a variety of ways. The invention involves numerous and varied embodiments of a various cleaning compositions and methods of making and using such cleaning compositions.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "cleaner" should be understood to encompass disclosure of the act of "cleaning"—whether explicitly discussed or not—and, conversely, were there effectively disclosure of the act of "cleaning", such a disclosure should be understood to encompass disclosure of a "cleaner" and even a "means for cleaning." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the cleaning compositions herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below, if any, are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A liquid detergent comprising: water; a combination of surfactants comprising an anionic linear dodecyl sulfate and an ethoxylated alcohol having $C_{6-18}$ moieties in substantially equal portion which in total comprise between about 25 wt. % and about 35 wt. % of said liquid detergent; and a pH control agent in a total amount which provides a pH in a range of about 8.25 to about 8.50 comprising a combination of citric acid and sodium hydroxide; an amount of borax of between about 1 wt. % and about 2 wt. %; a liquid polyethylene glycol-polyester soil-release copolymer of between about 3 wt. % and about 4 wt. %; propylene glycol of between about 4 wt. % and about 6 wt. %; a microbiocide of between about 0.10 wt. % and about 0.2 wt. %; an alpha-amylase of between about 0.3 wt. % and about 0.5 wt. %; a protease of between about 0.7 wt. % and about 1.0 wt. %; a chelating agent of between about 0.3 wt. % and about 0.6 wt. %; and an antiscale agent of between about 0.8 wt. % and about 1.0 wt. %; a brightener of about 0.05 wt. % and about 0.8 wt. %; a foam control agent of about 0.4 wt. % and about 0.6 wt. %; and an unscented mask.

* * * * *